US007178777B1

(12) United States Patent
Banker

(10) Patent No.: US 7,178,777 B1
(45) Date of Patent: Feb. 20, 2007

(54) ADJUSTABLE TENSION CLIP AND METHOD OF USE

(76) Inventor: Bret H. Banker, 2950-B Randolph Ave., Costa Mesa, CA (US) 92626

( * ) Notice: Subject to any disclaimer, the term of this patent is extended or adjusted under 35 U.S.C. 154(b) by 0 days.

(21) Appl. No.: 10/793,544

(22) Filed: Mar. 2, 2004

(51) Int. Cl.
*A47G 1/10* (2006.01)

(52) U.S. Cl. ..... 248/316.7; 24/569

(58) Field of Classification Search ..... 248/316.7, 248/316.4, 316.6, 316.8, 229.12, 229.16, 248/229.22, 229.26; 24/569, 535, 441, 335
See application file for complete search history.

(56) References Cited

U.S. PATENT DOCUMENTS

| | | | | |
|---|---|---|---|---|
| 398,508 | A | 2/1889 | Hatch | |
| 1,220,266 | A | 3/1917 | Ott | |
| 1,684,347 | A | 9/1928 | Dobbs | |
| 1,688,148 | A | 10/1928 | Martin | |
| 2,019,789 | A | 11/1935 | Mahannah | |
| 2,510,181 | A | 6/1950 | Jury | |
| 2,524,173 | A | 10/1950 | Peterson | |
| 2,740,735 | A * | 4/1956 | Swain | 148/532 |
| 2,795,834 | A * | 6/1957 | Szoke | 248/113 |
| 2,844,981 | A | 7/1958 | Steinc | |
| 2,896,896 | A | 7/1959 | Revzin | |
| 2,912,196 | A | 11/1959 | Johnson | |
| 3,343,684 | A * | 9/1967 | Galier | 211/89.01 |
| 4,171,800 | A | 10/1979 | Weaver | |
| 4,363,475 | A | 12/1982 | McCarty | |
| 4,575,038 | A * | 3/1986 | Moore | 248/505 |
| 4,787,591 | A | 11/1988 | Villacorta | |
| 4,895,329 | A | 1/1990 | Sloan | |
| 4,903,929 | A | 2/1990 | Hoffman | |
| 5,322,253 | A | 6/1994 | Stevens | |
| 5,765,822 | A | 6/1998 | Mead | |
| 5,791,609 | A * | 8/1998 | Hankins | 248/124.1 |
| 5,878,837 | A | 3/1999 | Kistner | |
| 6,334,242 | B1 * | 1/2002 | Scollard et al. | 24/459 |
| 6,494,411 | B1 | 12/2002 | Bjorklund | |
| 6,513,772 | B2 * | 2/2003 | Gary et al. | 248/231.91 |

FOREIGN PATENT DOCUMENTS

| | | | |
|---|---|---|---|
| EP | 274 635 | A1 * | 7/1988 |

* cited by examiner

*Primary Examiner*—Ramon O Ramirez
(74) *Attorney, Agent, or Firm*—John S. Christopher

(57) ABSTRACT

An adjustable tension clip selectively retains a tool. The clip includes a pair of resilient clip members positioned in spaced-apart, parallel alignment. Each of the clip members provides in sequence, from a proximal mounting end of the clip member to a distal clamping end of the clip member; a proximal planar section; a proximal C-shaped section; a medial planar section; a distal C-shaped section; a distal arcuate section; and a terminal outwardly-flared section for receiving the tool.

10 Claims, 7 Drawing Sheets

ADJUSTABLE TENSION CLIP AND METHOD OF USE

INCORPORATION BY REFERENCE

Applicant hereby incorporates herein by reference, any and all U.S. patents, U.S. patent applications, cited or referred to in this application.

BACKGROUND OF THE INVENTION

1. Field of the Invention

This invention relates generally to clamps and clips and more particularly to a clamp system having tension and position adjustment.

2. Description of Related Art

The following art defines the present state of this field:

Hatch, U.S. Pat. No. 398,508 describes an instrument holder consisting of a body, a clamp attached to the body, and the spring grasping arms projecting from the body.

Ott, U.S. Pat. No. 1,220,266 describes a device comprising an extension rod having oscillating joints at each end thereof, a clamp connected to one joint, each of said joints comprising a ring having a peripheral slot therein and a ring rotatable therein, a screw passing through both of said ring members for securing the joint in position, and a bottle holder connected to the joint opposite the clamp.

Dobbs, U.S. Pat. No. 1,684,347 describes a holder comprising a pair of spring actuated clamping members, a pivot connecting said clamping members together for co-action, a clamp, and means between the pivot and the clamp allowing the clamp to have universal movement.

Martin, U.S. Pat. No. 1,688,148 describes a lamp-holder comprising a tubular standard having means whereby it may be confined in a predetermined position on a F support and provided with a contracted outer end having a mouth coaxial with the standard, and diametrically opposite slots opening into the mouth, a spring-pressed shoe within the standard, said shoe and contracted end forming a ball-shaped frictional socket, and a lamp-supporting clip having free end portions which a lamp member is insertable, and a trunnion projecting from the mid-length portion of the clip and composed s of a ball adapted to turn in said socket, and a. neck connecting the ball with the clip, the trunnion being movable bodily and rotatable in the said mouth and slots, the arrangement being such that the trunnion may swing in the slots and mouth from side to side of the standard, so that the clip may be located at either of two diametrically opposite sides of the standard, and in various intermediate positions, the trunnion being adapted to turn on its own axis to permit rotative adjustment of the clip, and various angular positions of a lamp member held thereby, when the clip is in either of said positions, the clip and its trunnion being arranged to hold a lamp member in close proximity to said frictional socket, so that the socket is adapted to frictionally maintain the clip and the lamp member in any position to which they are movable.

Mahannah, U.S. Pat. No. 2,019,789 describes an adjustable support for clamps comprising a U-shaped member having a stud integrally joined to one leg, the stud being axially bored, the other leg being apertured and threaded in axial alignment with the stud, to engage a set screw as securing means for the said U-shaped member to a stationary support, a clamp comprising a pair of jaws pivotally connected at their corresponding ends, the free ends of the jaws adapted to contact in parallelism for a short distance and each having a notch adjacent the inward terminating point of each parallel portion, means to move the free ends to and from each other, a rod and a sleeve telescopingly engaging, the rod being adapted to turn in the sleeve and means to rigidly secure said rod and sleeve together, a universal jointed means connecting the jaws to the outer end of the rod and means to rigidly secure the Joints, a pin pivotally connected to the outer end of the sleeve for rocking movement and means to secure the same against movement, the said pin being adapted to engage in the bore of the stud and adapted to turn in the same and means to bind the stud rigid to the pin.

Jury, U.S. Pat. No. 2,510,181 describes a clamp comprising a pair of pivoted, channel shaped, clamping jaws, said jaws being flanged and having in the flanges of one of the jaws inwardly opening, aligned V-shaped notches, the other jaw having transversely aligned spaced clamping blocks disposed opposite said notches.

Peterson, U.S. Pat. No. 2,524,173 describes a portable flashlight bracket comprising a C-clamp with a thumb screw threaded in the end of one of the two arms thereof and directed toward the other arm, a spring band extending from said other arm, and a double-end yoke having the arms at one end thereof straddling the other extending end of the spring band and the other arms at the other end of the yoke being arcuately curved to describe a semi-circle and carrying resilient sleeves or rollers upon the outer ends thereof, the features which include, a tubular member integral with the outer extending end of said spring band, a thumb screw extending through the first-mentioned arms of the yoke and said tubular member to secure the yoke to the latter, which include having the latter arms on said yoke divergent and smaller than the arcuate arms thereof, having the-spring band and C-clamp rigidly connected to form a substantially S-shaped unit disposed in a single plane while the arms of the yoke extend in a second plane substantially at right angles to said single plane.

Steine, U.S. Pat. No. 2,844,981 describes a device for supporting a toggle wrench or the like comprising a metal member having spaced portions each formed into a socket of generally C-shaped cross section and both being in registering alignment and arranged to receive a stationary-jaw handle of a toggle wrench, the portion of said member intermediate said sockets being substantially flat and having a series of arcuately arranged apertures therein, a C-clamp pivotally secured to said member at a point coincident with the center of the arc of said apertures, said clamp being adapted to secure am member to a supporting surface, and a pin slidably carried in said clamp and arranged to be selectively received in one of said apertures to lock said member in a selective angular position of agent relative to said clamp.

Revzin, U.S. Pat. No. 2,896,896 describes a C-type accessory clamp of the type having primary and secondary clamp adjusting means the improvement comprising a first inverted L-shaped clamping part having a horizontally extending leg portion and a downwardly extending leg portion, said downwardly extending leg portion being of greater length than said horizontally extending leg portion and having an inwardly opening U-shaped cross section throughout its length, a second L-shaped clamping part having a horizontally extending leg portion and an upwardly extending leg portion, said upwardly extending leg portion being of longer length than said horizontally extending leg portion of said second L-shaped member and having a generally T-shaped cross section throughout its length, said upwardly and downwardly extending leg portions being adapted to ht in nesting relation with the exposed flange of said T-shaped cross section overlying the end portions of said U-shaped cross section, a pivot pin pivotally interconnecting said L-shaped clamping parts, said pivot pin being adjacent the corner of said first mentioned clamping part and pivotally supporting the end of said upwardly extending portion of said second mentioned L-shaped clamping part, said downwardly extending leg portion of said first mentioned clamping part having a boss thereon adjacent the lower end thereof, an adjusting screw received in said boss and extending through said downwardly extending leg portion and into engagement with said upwardly extending leg portion whereby upon manipulation of said adjusting screw said clamping parts are caused to pivot in a clamping direction, said horizontal leg portion of one of said L-shaped clamping parts having an inwardly facing clamping pad thereon, said horizontal leg portion of the other of said L-shaped clamping parts having an adjustable opposing clamping pad thereon. The clamping pad carried by said horizontally extending leg portion of said first mentioned clamping part whereby there is substantial multiplication of the clamping forces exerted upon tightening of said adjusting screw, a clamping ring carried integrally with said first mentioned clamping part along a side wall of said downwardly extending portion, said clamping ring defining a tubular opening adjacent the outer surface of said side wall having its longitudinal axis parallel with said side wall.

Johnson, U.S. Pat. No. 2,912,196 describes a rod holder of the type which may be mounted on supporting means comprising a support stand having an inclined bore at one end and a foot at the other end thereof, said foot having a plurality of peripheral teeth a tube slidably and rotatably received by said inclined bore, said tube comprising a longitudinally slit cylinder, one end of said cylinder being angularly cut, flared and notched, a damp member including a clamping fork and a clamping screw, said clamping fork being adapted to overlie said support stand foot, and splines on said clamp member adjacent said fork and engagable with said peripheral teeth when said clamping fork is overlying said foot to seam the support stand against rotation, said clamping screw serving to clamp said stand to the supporting structure.

Weaver, U.S. Pat. No. 4,171,800 describes a work holder assembly for retaining jewelry articles, the work holder including a clamp assembly for clamping retention of the jewelry article, a bench mount assembly, and a gimbaled-type connector coupling the clamp with the bench mount. The gimbal connector includes a ring assembly rotatably and hingedly connected with the bench mount and rotatably connected with the clamp. A filing block, interchangeable with the clamp assembly, is adapted for connection with the bench mount.

McCarty, U.S. Pat. No. 4,363,475 describes a vise-like C-clamp with adjusting screw and wherein two elongated square bars fixedly attached to one jaw thereof and the clamping end of the adjusting screw whereby a pair of gripping heads may be selected from a group of variously shaped heads and oppositely and interchangeably arranged on each of the bars. The clamp may be hand held or adjustably mounted in a supporting base for gripping and positioning variously shaped work pieces in horizontal, vertical, and angularly held positions while work is performed thereon.

Villacorta, U.S. Pat. No. 4,787,591 describes a simple, inexpensive clamp comprising of a flexible "C"-shaped, fixed-diameter clamping means, a rigid support member, and a "C"-shaped anchoring means whose overall design and construction allows the user to fasten, secure, and release objects quickly and easily with a minimum level of dexterity.

Sloan, U.S. Pat. No. 4,895,329 describes a clamp for holding a flashlight in position, while removably securing it to a support, having a generally U-shaped retaining member that is resistant to misbending or over bending and a threaded connector, cooperative with the retaining member, to enable precise adjustment of gripping tension on the flashlight body.

Hoffman, U.S. Pat. No. 4,903,929 describes a holding device which clamps onto a wide variety of fixtures, such as furniture, pipes, counter tops, trees, rocks, fences, etc., and holds pole-shaped objects, such as billiards cues, gun barrels, fishing rods, measurement instruments, painting tools, etc., is disclosed. A C-clamp is formed from a plastic U-shaped member, which movably couples to a plastic, pole-shaped member. The U-shaped member has a plurality of retained openings therein for selective installation of one or more retainers. A retainer press-fits into one of the retainer openings and is rotatable therein so that a wide variety of holding orientations may be achieved. The retainer includes an open, curved, resilient member, which holds the pole-shaped object. The held object is installed by being pressed into the interior of the curved member at the opening thereof. Such pressing expands the curved member sufficiently so that the opening permits passage of the held object. Resilience of the curved member then urges the curved member to return to its quiescent shape. The held object is removed by being pulled out of the retainer through the opening therein.

Stevens, U.S. Pat. No. 5,322,253 describes a universal mounting system for attaching any of a variety of I.V. devices to an I.V. pole. The mounting system has both a C-clamp and a spring-actuated clamp. The C-clamp attaches to the I.V. pole with a threaded stud that is manually adjustable with a knob. The spring-actuated clamp secures the I.V. device and is pivotally connected to the C-clamp by a pivot-screw that extends through both a spring and a non-threaded bore that is formed in the C-clamp, and exits at a recess area on the C-clamp. The pivot-screw is threaded into a threaded bore that extends through a projection on the spring-actuated clamp. The projection fits within the recess to prevent pivoting of the spring-actuated clamp relative to the C-clamp. The spring-actuated clamp has two aligned, opposing and spring-loaded clips for holding I.V. devices. The clips pivot and fulcrum together at a pivot point between the ends of each clip so as to bring the clip ends together to a clamped position on an I.V. device.

Mead, U.S. Pat. No. 5,765,822 describes a method and clamping apparatus for securely holding objects. The clamping apparatus works in conjunction with hand tools used for holding objects such as a pair of locking pliers, micrometers, tweezers, tongs, etc. and can be attached to a workbench, table, or other stable surface. A preferred embodiment of the clamping apparatus has two main components: a base module which can be readily attached to a workbench, table, or similar stable surface; and a clamping module which is used to securely hold the hand tool. The two modules fit together by inserting several dowel pieces located on one module into corresponding holes located in the other module. The two separate modules are held together by frictional contact between the dowel pieces and the holes that occurs due to bending moments created when the base module is attached to a stable surface. A slight deformation of the base module causes the dowel pieces located on one module to exert pressure against the internal sidewalls of the holes in the body of the other module. This frictional binding is sufficient to keep the two modules from separating. In the case of a pair of locking pliers, the clamping module is designed to hold the locking pliers in place by turning a screw, which contacts the head portion of the locking pliers.

Kistner, U.S. Pat. No. 5,878,837 describes a tool holder for mounting on a boom lift bucket, the holder having a first and second plate rotatable with respect to each other and having a resilient tool engagement member mounted to the second plate Bjorklund, U.S. Pat. No. 6,494,411 describes a cable-supporting apparatus. One embodiment of the invention includes a rigid support member that may be attached to a framework that supports one or more components. At least one cable support member is attached to the rigid support member for receiving a portion of at least one cable therethrough. The cable support members may comprise split rings that each defines central cable-receiving area that is surrounded by rigid portions of the split ring.

Our prior art search with abstracts described above teaches: an instrument holder, a nursing bottle holder, a quick attachable holder, an adjustable lamp holder, an adjustable support for clamps, a clamp and bracket assembly, a flashlight holding device, a support means for toggle-actuated wrenches and the like, an accessory clamp, a rod holder, a bench mounted support for jewelry articles and the like, a vise-like C-clamp for gripping variously shaped work pieces in varying positions, a laboratory clamp, a flashlight clamp, a portable apparatus for holding objects, a universal I.V. stand mounting system, a clamping apparatus for securely holding objects, a tool holding apparatus, and a removable cable support apparatus, but does not teach a clamping system with adjustable clamp tension, position adjustment and arcuate opposing resilient fingers. The present invention fulfills these needs and provides further related advantages as described in the following summary.

SUMMARY OF THE INVENTION

The present invention teaches certain benefits in construction and use which give rise to the objectives described below.

An adjustable tension clip selectively retains a tool. The clip includes a pair of mirror-image, conforming, resilient clip members positioned in spaced-apart, parallel alignment. Each of the clip members provides in sequence, from a proximal mounting end of the clip member to a distal clamping end of the clip member: a proximal planar section; a proximal C-shaped section; a medial planar section; a distal C-shaped section; a distal arcuate section; and a terminal outwardly-flared section. Each of the clip members may alternately have one or more C-shaped sections.

A primary objective of the present clamping invention is to provide an apparatus and method of use of such apparatus that provides advantages not taught by the prior art.

Another objective is to provide such an invention capable of being adjusted for tension, that is, holding power.

A further objective is to provide such an invention capable of being adjusted for angular position.

A still further objective is to provide such an invention capable of being easily clamped onto a supporting structure and easily releasing clamping force for repositioning.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1:
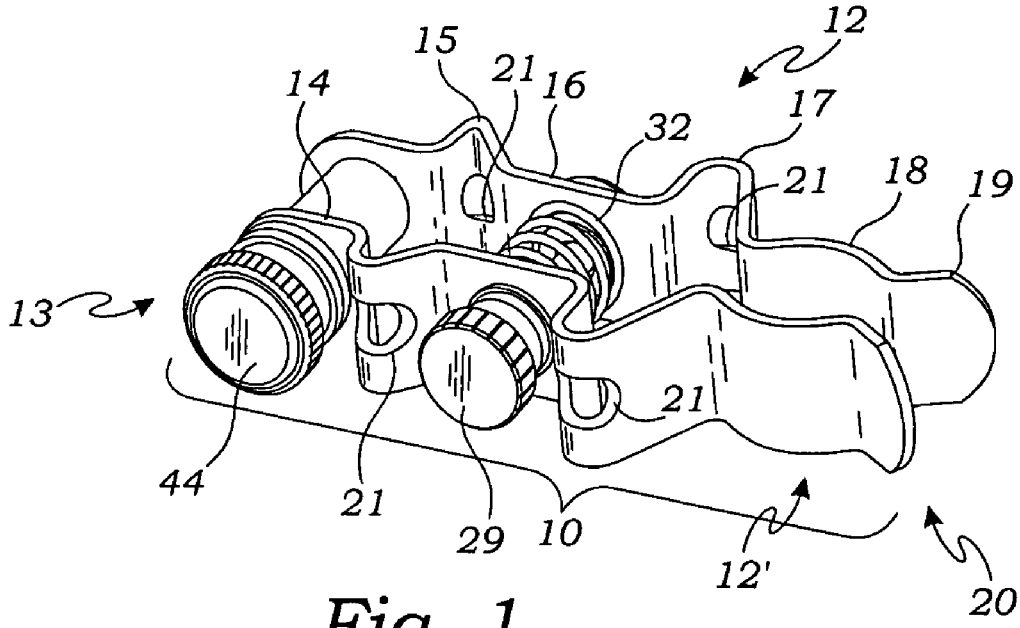
FIG. 1 is a perspective view of the invention.
Figure 2:
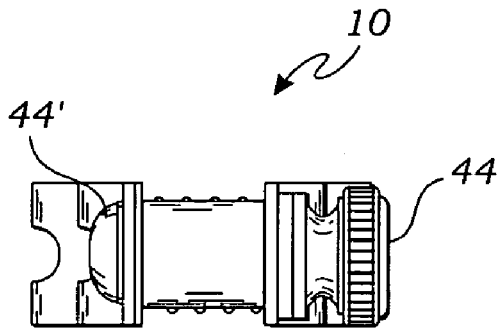
FIG. 2 is a rear elevational view thereof.
Figure 3:
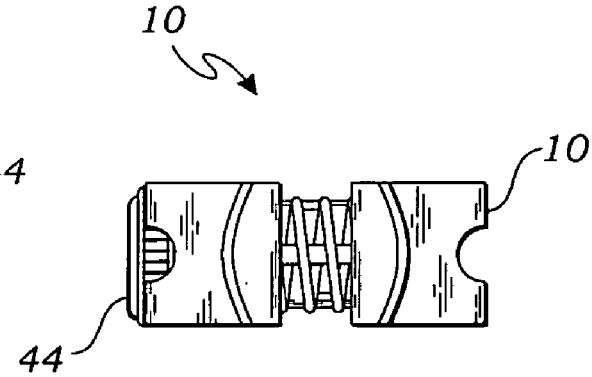
FIG. 3 is a front elevational view thereof.
Figure 4:
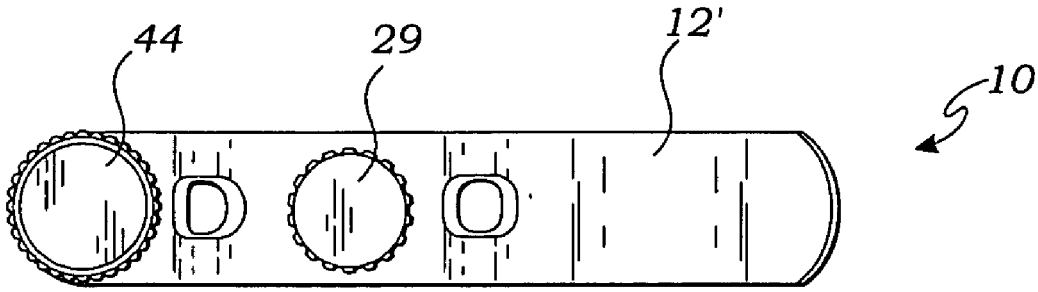
FIG. 4 is a left side elevational view thereof.
Figure 5:
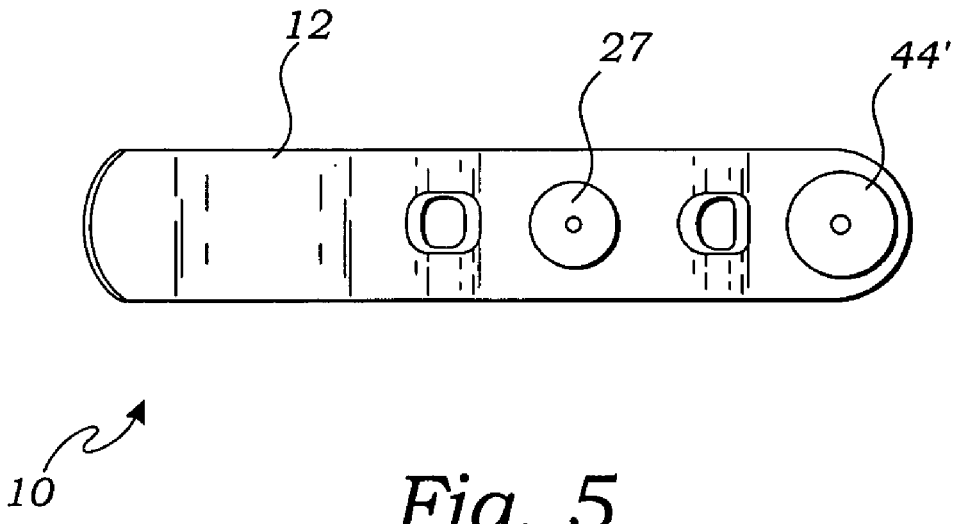
FIG. 5 is a right side elevational view thereof.
Figure 6:
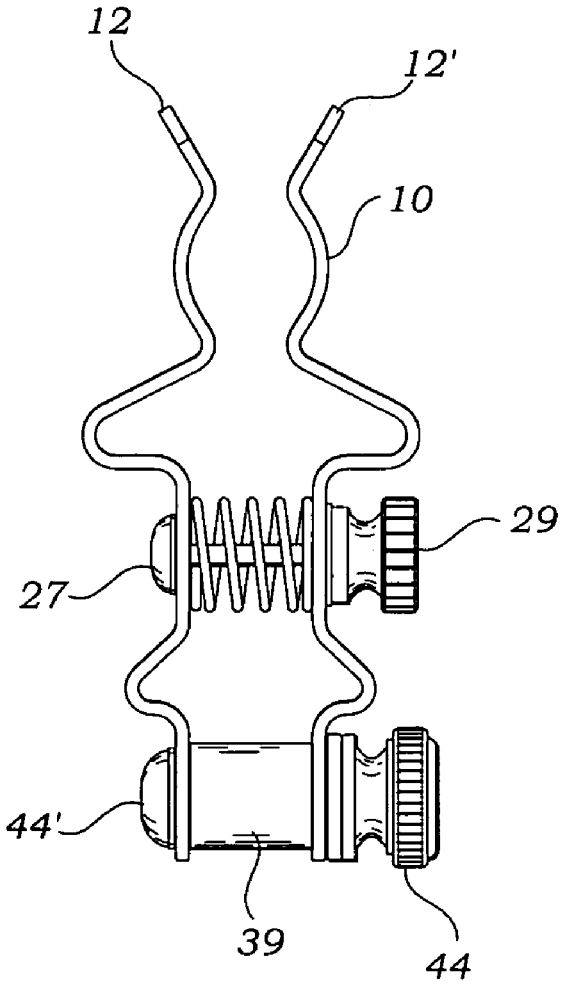
FIG. 6 is a top plan view thereof.
Figure 7:
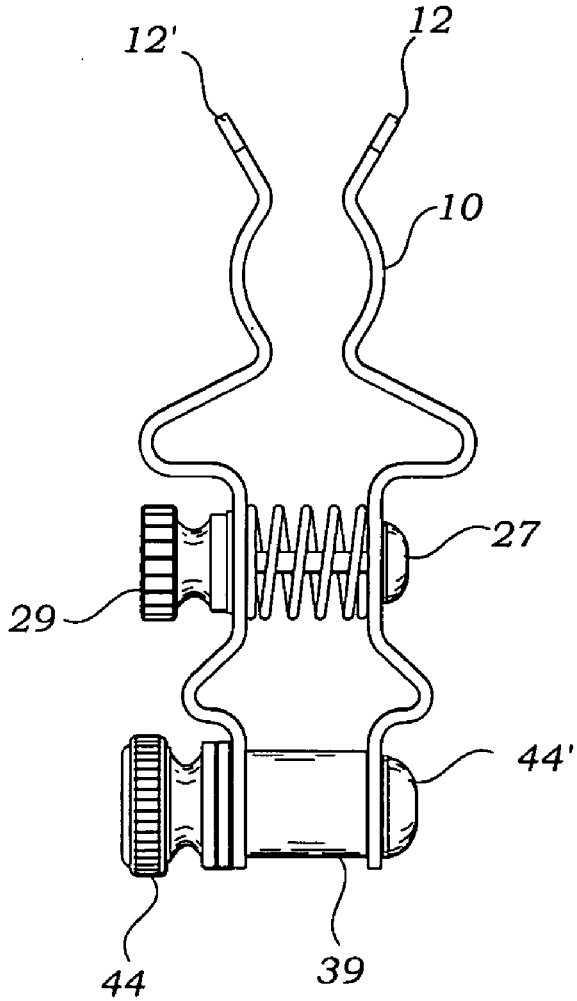
FIG. 7 is a bottom plan view thereof.
Figure 11:
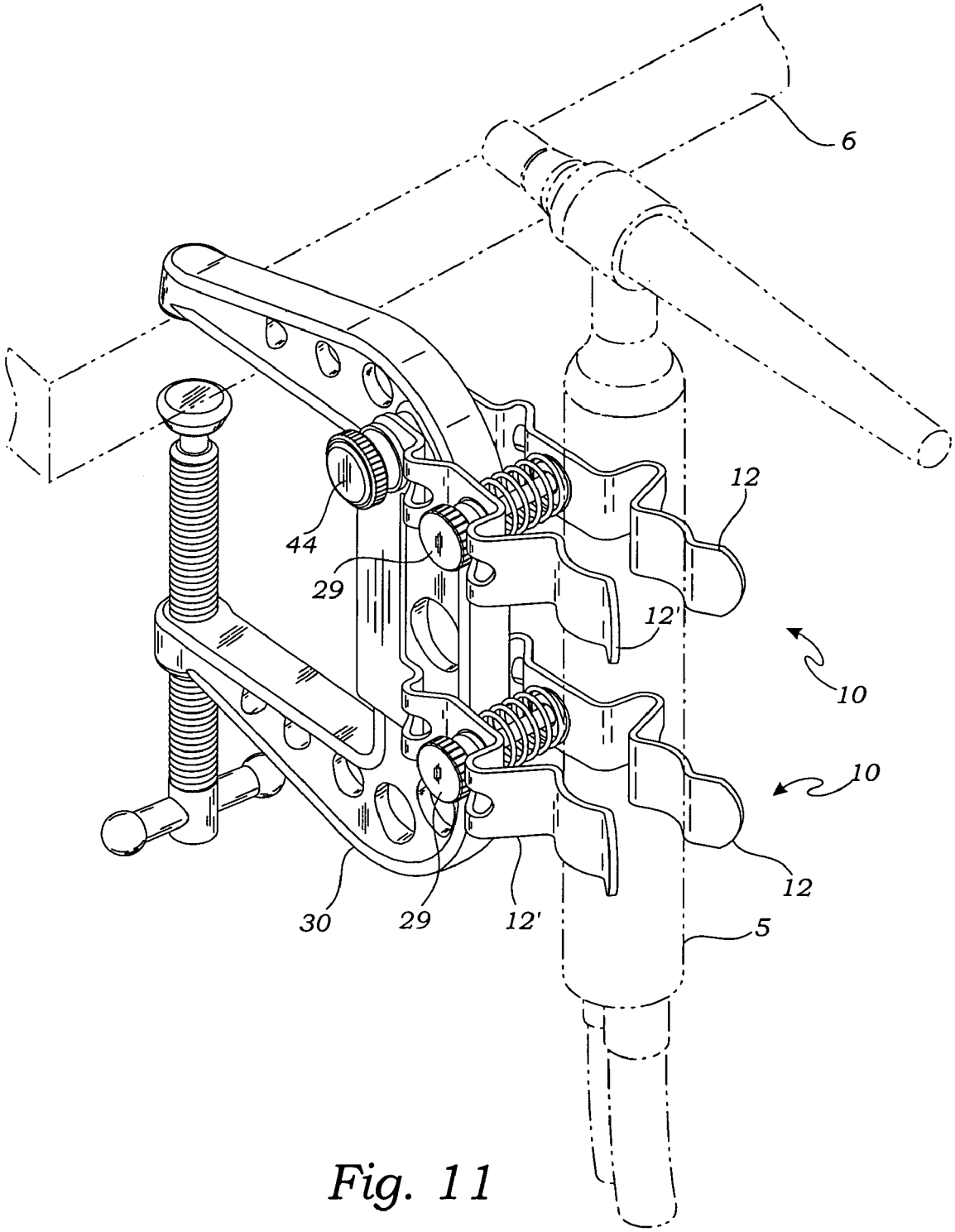
FIG. 11 is a perspective view thereof showing the method of use of the invention.

As shown in FIG. 1, the present invention is an adjustable tension clip assembly 10 used for selectively retaining a tool 5 (see FIG. 11) such as a welding torch. The tension clip assembly 10 is engaged with a clamp 30 as shown in FIG. 11, which is able to be removably mounted onto a surface of choice 6. The clamp 30 may be a common C-clamp, as shown, or any other type of clamping device as described in the prior art references incorporated into this application by reference or as known in the art and may include, for instance, a magnetic mount or clamping pliers. In referencing a "C-clamp" in this text and in the drawing Figs., it shall be taken to mean any other known type of clamping device. The purpose of clamp 30 is to securely fasten the tension clip assembly 10 to any convenient mounting member, so as to position the tension clip assembly 10 at a useful position, and hold it in such position, so that it may be advantageously used for holding a tool 5. Again, refer to FIG. 11 as an example of how clamp 30 and tension clip assembly 10 are used in conjunction with each other to obtain the advantages of both devices.

Figure 8:
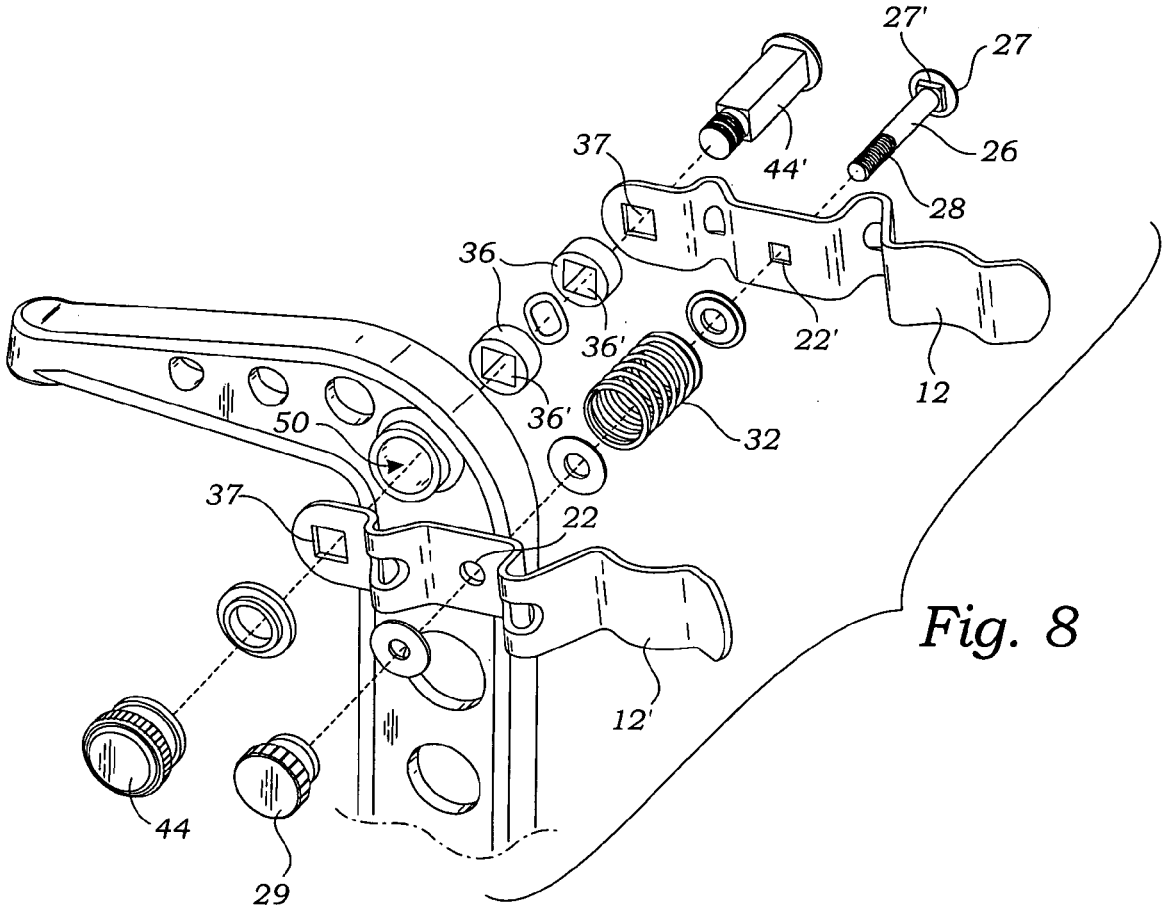
FIG. 8 is a partial exploded perspective view of thereof including a C-clamp for mounting the invention shown in FIGS. 1–7.
Figure 9:
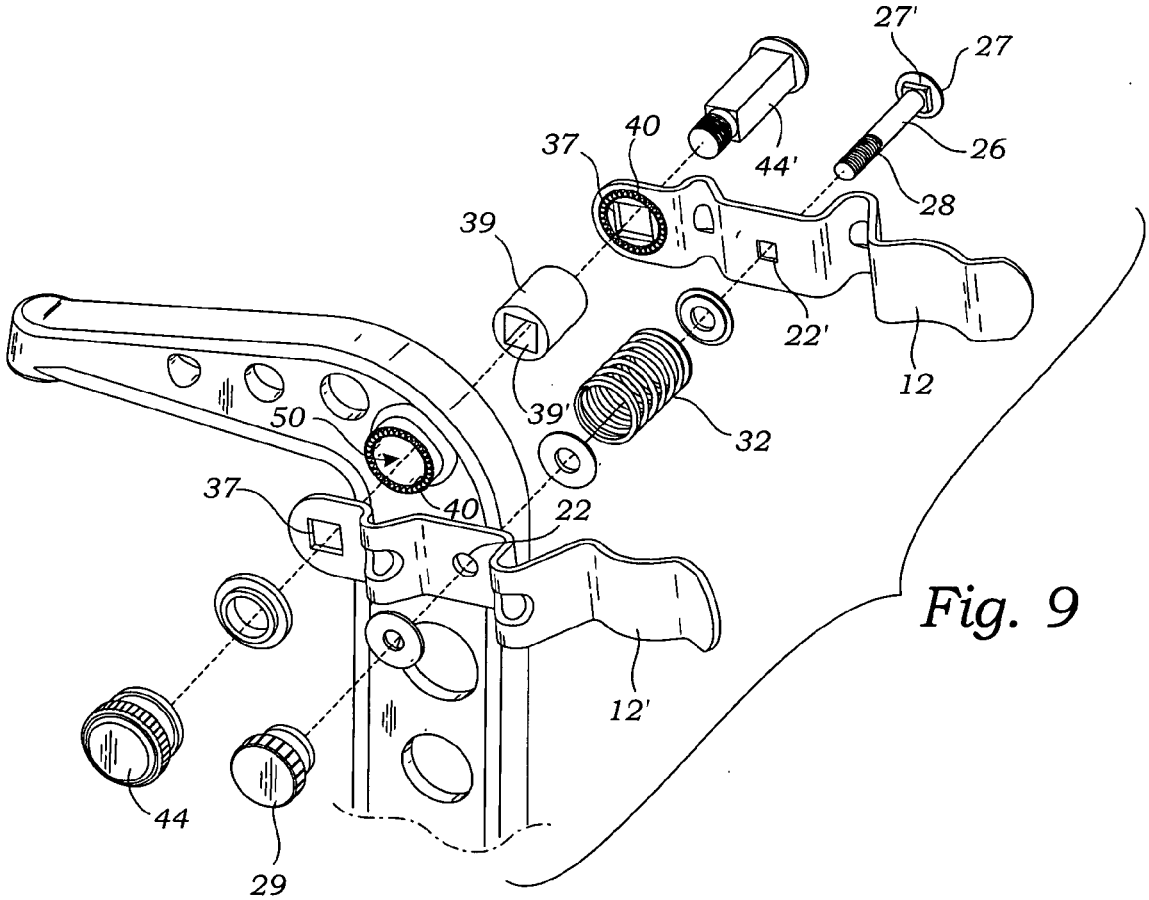
FIG. 9 is similar to FIG. 8, showing hardware item 39 instead of hardware items 36, plus further element 40.
Figure 10:
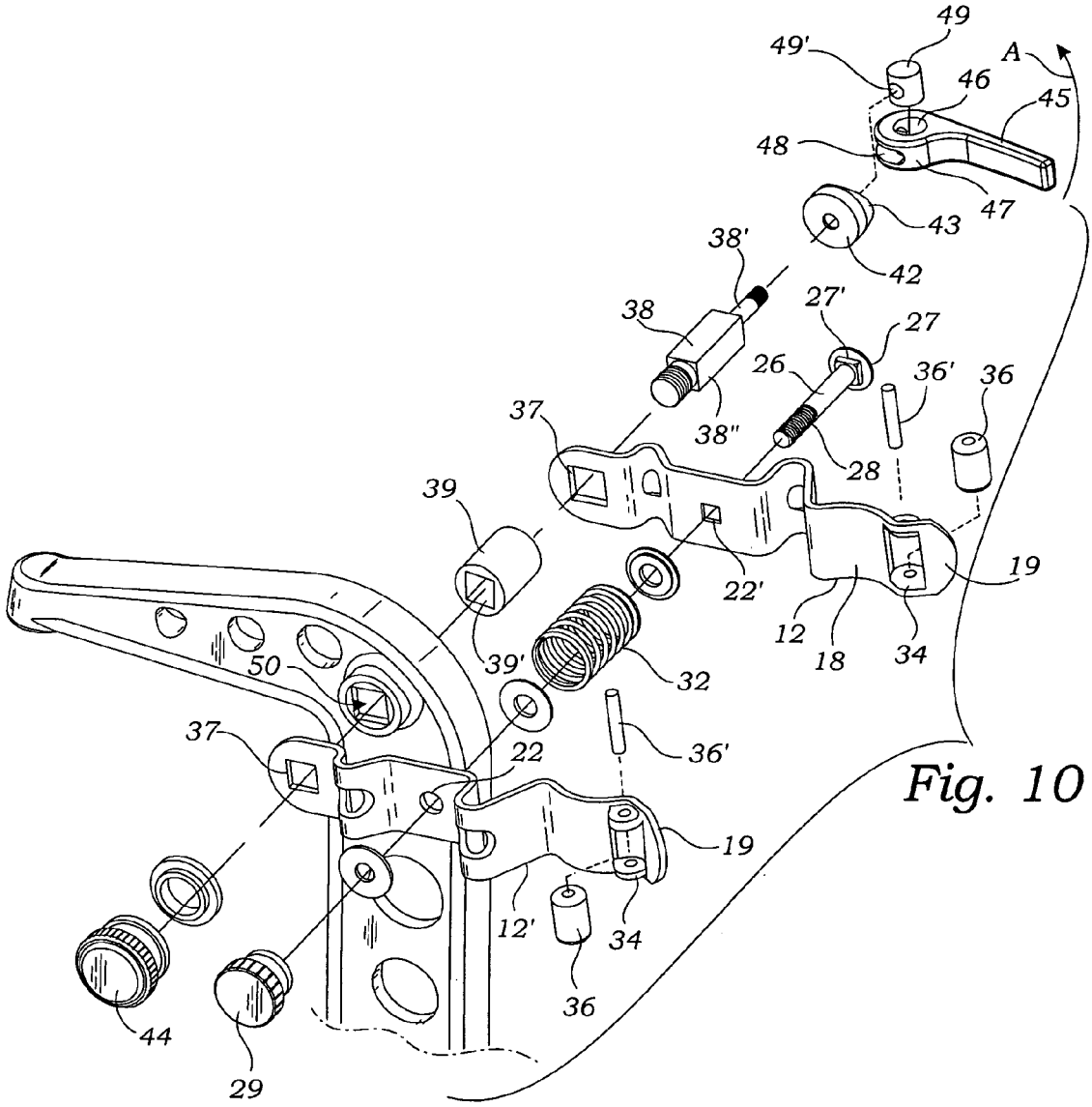
FIG. 10 is similar to FIG. 9, showing hardware items 38, 42, 45 and 49 instead of item 44', and further element 34, and hardware items 36 and 36'.

FIGS. 1–7 clearly define the decorative and mechanical utility aspects and elements of the tension clip assembly 10. FIG. 1 distinctly points out the separate elements of the invention. FIGS. 8–10 define constructional details. The tension clip assembly 10 has a pair of mirror-image, conforming, resilient clip members 12 and 12' positioned in spaced-apart, parallel alignment, as shown in each of the figures. Preferably, each of the clip members 12 and 12' provides, in sequence, from a proximal mounting end 13 to a distal clamping end 20: a proximal planar section 14; a proximal C-shaped section 15; a medial planar section 16; a distal C-shaped section 17; a distal arcuate section 18; and a terminal outwardly-flared section 19. These are clearly shown in FIGS. 6–10.

Referring now to FIG. 8, a through-hole 22 (round) or 22' (non-round) is formed in each medial planar section 16 and engaged with adjusting bolt 26 and adjusting nut 29 to join the clip members 12, 12' together with selective tension. To accomplish this, a spring device 32 is installed between the clip members 12, 12' in substantial contact with the respective medial planar sections 16, the spring device 32 biasing the clip members 12, 12' away from one another and against which the clip members 12, 12' are tightenable to adjust the space between the respective distal arcuate sections 18 for selectively gripping the tool 5. In this manner, holding tension on tool 5 is selectively adjusted.

Adjusting bolt 26 has a head 27 and an opposing threaded portion 28 so that adjusting nut 29 may be selectively engaged with the threaded portion 28. As defined, at least one of the through-holes 22, 22' is formed having a substantially non-round through-hole profile; and the head 27 is formed with an inwardly-projecting base 27' having a corresponding non-round profile configured to engage the through-hole 22' such that the adjusting bolt 26 cannot rotate relative to the clip members 12, 12', thereby enabling the tightening of the adjusting nut 29 onto the threaded portion 28.

Preferably, the spring device 32 comprises a coil spring through which the adjusting bolt 26 is installed. However, the coil spring may be any biasing device such as a different type of metal spring or a rubber material or other resilient material.

Referring now to FIG. 10, preferably, a receiver 34 is formed at the transition between the respective distal arcuate sections 18 and the terminal outwardly-flared sections 19, and a pinned roller 36 and 36' is mounted within each receiver 34 so as to facilitate the placement of tool 5 in passing between the distal arcuate sections 18 and into rest in the space between the respective distal arcuate sections 18. The rollers 36 enable the clip members 12 and 12' to be quite close without demanding excessive tool insertion force.

Referring now to FIGS. 8 and 9, preferably, a mounting aperture 37, more preferably a square hole, is formed in each of the proximal planar sections 14. Clip members 12, 12' are mounted to clamp 30 using bolt 44', hand nut 44 and bushings 36 or 39 having non-round holes 36' and 39' respectively therethrough. Selected washers are applied as appropriate and as shown. This hardware is installed within mounting bore 50 and clip members 12, 12' in such that the clip members 12, 12' are rotationally fixed relative to the bolt 44', whereby tightening the hand nut 44 secures the clip members 12, 12' at a selected angle relative to clamp 30.

Preferably, as shown in FIG. 9, apertures 37 in the proximal planar sections 14 may be formed with radial ribs 40 circularly positioned to engage corresponding ribs 40 in clamp 30, whereby tightening hand nut 44 secures the clip assembly 10 at a selected angle relative to clamp 30 and such angle will not easily be caused to change due to the ribs 40.

Now referring to FIG. 10, a camming washer 42 having an angled camming surface 43 is rotatably installed on a first end 38' of bolt 38. Knurled hand nut 44 is threadably fastened on an opposite second end 38" of the mounting bolt 38. A camming lever 45 has an offset hole 46 and a contoured base surface 47 configured to slidably engage the camming surface 43. The base surface 47 is formed with an arcuate slot 48 perpendicular to the offset hole 46 and communicating therewith. The camming lever 45 is installed on the mounting bolt 38 such that the first end 38' passes through the slot 48 and into the offset hole 46. A retaining pin 49 having a threaded cross-hole 49' is installed within the offset hole, and the first end 38' of the mounting bolt 38 is threadably engaged with the cross-hole 49' to retain the camming lever 45 rotatably on the mounting bolt 38. The camming lever 45 selectively pivots about the retaining pin 49 frictionally engaging the camming surface 43 of the camming washer 42 with the base surface 47 of the camming lever 45 to tighten the mounting means 38 and secure the clip assembly 10 relative to the supporting structure 30. Now, with hand nut 44 tightened to an extent that the clip assembly 10 cannot rotate on clamp 30 when camming lever 45 is moved fully in the direction of arrow A in FIG. 10, one may loosen clip assembly 10 for repositioning it merely by releasing tension using camming lever 45 and then selectively reapply tension. Alternatively, instead of using threaded engagements, retaining pin 49 could be a spring or dowel pin engaging a hole drilled thru first end 38' of bolt 38.

Preferably, the proximal C-shaped sections 15 and the distal C-shaped sections 17 may be formed with a relief cutout 21 so as to reduce stiffness of the clip members. See FIG. 1.

Preferably, clip assembly 10 is beneficially married to C-clamp 30 as is shown in the Figs. To accomplish this, the supporting structure, in this case C-clamp 30 (shown in FIG. 11), provides a mounting bore 50 as shown in FIGS. 8–10. The above described hardware means for mounting is installed through respective ones of the mounting apertures 37 and through the mounting bore 50 as is shown in the Figs.

As shown in FIG. 9, the mounting bore 50 is advantageously provided with radially projecting ribs 40 similar to those described above on the proximal planar sections 14. In this case the ribs 40 of sections 14 and of mounting bore 50 are mated and allow incremental adjustment of clip 10 in rotating to a selected angle, whereby tightening the mounting hardware using hand nut 44 engages the ribs 40 and secures the clip assembly 10 at the selected angle relative to the supporting structure 30.

The method of use of the present invention comprises the steps of: positioning the clip members 12, 12' in the spaced-apart, parallel alignment on opposite sides of the supporting structure 30 such that the mounting apertures 37 formed in proximal planar sections 14 of the clip members 12, 12' are substantially adjacent to the mounting bore 50 formed in the supporting structure 30; installing the mounting bolt 38 or 44' through the respective mounting apertures 37 and the mounting bore 50 so as to mount the clip members 12, 12' on the supporting structure 30; adjusting the adjusting nut 29 threadably coupled to the adjustment bolt 26 installed through through-holes 22, 22' formed in the medial planar sections 16 of the respective clip members 12, 12' to adjust the space between distal arcuate sections 18 of the clip members; and inserting the tool 5 into the space between the opposite distal arcuate sections 18 so that it is positively retained between the clip members 12, 12'.

The method preferably comprises the further steps of: pivoting the clip members 12, 12' to a desired angle relative to the supporting structure 30; and then tightening the mounting hardware to secure the clip members at the desired angle.

The method preferably further includes the step of rotationally fixing the mounting bolt 38 relative to the clip members 12, 12' so as to coordinate and engage non-round portions thereof.

The method preferably further comprises the further steps of contacting respective terminal outwardly-flared sections 19 of the clip members 12, 12' with the tool 5; shifting the tool 5 proximally toward the distal arcuate sections 18 of the clip members 12, 12'; and flexing the clip members 12, 12' outwardly as the tool 5 is inserted between the terminal outwardly-flared sections 19 and the distal arcuate sections 18.

The method preferably further comprises the further step of sliding the tool 5 across rollers 36 mounted in receivers 34 configured at the transition between the distal arcuate sections 18 and respective terminal outwardly-flared sections 19 of the clip members 12, 12'.

The enablements described in detail above are considered novel over the prior art of record and are considered critical to the operation of the instant invention and to the achievement of the above described objectives. The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An adjustable tension clip apparatus for selectively retaining a tool, said apparatus comprising:

at least two resilient clip members held in spaced-apart alignment;

each of said clip members providing in sequence, from a proximal mounting end of said clip member to a distal clamping end of said clip member, a proximal planar section;

a medial planar section;

a distal arcuate section;

a terminal outwardly-flared section; and at least one of said clip members further comprises a C-shaped section between at least one of:

a) said proximal planar section and said medial planar section, and b) said medial planar section and said distal arcuate section.

2. The apparatus of claim 1 wherein at least one of said C-shaped sections is formed with a relief cutout therein, thereby providing added flexibility thereto.

3. An adjustable tension clip apparatus for selectively retaining a tool, said apparatus comprising:

at least two resilient clip members held in spaced-apart alignment;

each of said clip members providing in sequence, from a proximal mounting end of said clip member to a distal clamping end of said clip member, a proximal planar section;

a medial planar section;

a distal arcuate section;

a terminal outwardly-flared section; and an adjustable fastener engaged with said medial planar sections of said clip members, said adjustable fastener enabled for setting said spaced-apart alignment of said clip members.

4. The apparatus of claim 3 further comprising a spring device positioned between said clip members for biasing said clip members away from one another.

5. The apparatus of claim 3 wherein said adjustable fastener is rotationally fixed relative to said clip members.

6. The apparatus of claim 3 wherein said clip members are engaged by a means for mounting, said mounting means adapted for selectively, rotationally, positioning said clip members.

7. The apparatus of claim 6 wherein said clip members are rotationally fixed relative to said mounting means.

8. An adjustable tension clip apparatus for selectively retaining a tool, said apparatus comprising:

at least two resilient clip members held in spaced-apart alignment;

each of said clip members providing in sequence, from a proximal mounting end of said clip member to a distal clamping end of said clip member, a proximal planar section;

a medial planar section;

a distal arcuate section;

a terminal outwardly-flared section; and at least one of said clip members provides a receiver, said receiver engaging a rotatable roller positioned for passing said tool through said outwardly-flared sections and into contact with said distal arcuate sections of said clip members.

9. An adjustable tension clip apparatus for selectively retaining a tool, said apparatus comprising:

at least two resilient clip members held in spaced-apart alignment;

each of said clip members providing in sequence, from a proximal mounting end of said clip member to a distal clamping end of said clip member, a proximal planar section;

a medial planar section;

a distal arcuate section;

a terminal outwardly-flared section;

said clip members are engaged by a means for mounting, said mounting means adapted for selectively, rotationally, positioning said clip members; and said mounting means further comprises a lever enabled for alternately tightening and loosening said mounting means for positional adjustment of said clip members.

10. An adjustable tension clip apparatus for selectively retaining a tool, said apparatus comprising:

at least two resilient clip members held in spaced-apart alignment;

each of said clip members providing in sequence, from a proximal mounting end of said clip member to a distal clamping end of said clip member, a proximal planar section;

a medial planar section;

a distal arcuate section;

a terminal outwardly-flared section;

said clip members are engaged by a means for mounting, said mounting means adapted for selectively, rotationally, positioning said clip members; and a clamp engaged with said mounting means of said clip members, said clamp enabled for further engaging a support structure for positioning said clip members advantageously for receiving said tool.

* * * * *